US009477182B2

(12) United States Patent
Ikebuchi et al.

(10) Patent No.: US 9,477,182 B2
(45) Date of Patent: Oct. 25, 2016

(54) FIXING DEVICE OF AN IMAGE FORMING APPARATUS THAT UTILIZES EDGE DETECTIONS FOR HEAT SHIELD POSITIONAL DETERMINATIONS

(71) Applicants: Yutaka Ikebuchi, Kanagawa (JP); Hideo Nagafuji, Kanagawa (JP); Yuji Arai, Kanagawa (JP); Kohichi Utsunomiya, Kanagawa (JP); Arinobu Yoshiura, Kanagawa (JP); Kiho Sai, Tokyo (JP); Motoyoshi Yamano, Kanagawa (JP); Shohei Saito, Kanagawa (JP)

(72) Inventors: Yutaka Ikebuchi, Kanagawa (JP); Hideo Nagafuji, Kanagawa (JP); Yuji Arai, Kanagawa (JP); Kohichi Utsunomiya, Kanagawa (JP); Arinobu Yoshiura, Kanagawa (JP); Kiho Sai, Tokyo (JP); Motoyoshi Yamano, Kanagawa (JP); Shohei Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/806,558

(22) Filed: Jul. 22, 2015

(65) Prior Publication Data

US 2016/0033906 A1 Feb. 4, 2016

(30) Foreign Application Priority Data

Jul. 31, 2014 (JP) ..... 2014-156575

(51) Int. Cl.
*G03G 15/20* (2006.01)

(52) U.S. Cl.
CPC ..... *G03G 15/2017* (2013.01); *G03G 15/2042* (2013.01)

(58) Field of Classification Search
None
See application file for complete search history.

(56) References Cited

U.S. PATENT DOCUMENTS

| | | | | |
|---|---|---|---|---|
| 9,389,550 | B2 * | 7/2016 | Saito | G03G 15/2017 |
| 2006/0029411 | A1 | 2/2006 | Ishii et al. | |
| 2007/0292175 | A1 | 12/2007 | Shinshi | |
| 2011/0176822 | A1 | 7/2011 | Ishii et al. | |
| 2014/0064804 | A1 | 3/2014 | Yamaguchi et al. | |
| 2014/0072355 | A1 | 3/2014 | Tamaki et al. | |
| 2014/0079424 | A1 | 3/2014 | Ikebuchi et al. | |

(Continued)

FOREIGN PATENT DOCUMENTS

| | | |
|---|---|---|
| JP | 2006-078549 | 3/2006 |
| JP | 2007-334205 | 12/2007 |

(Continued)

OTHER PUBLICATIONS

U.S. Appl. No. 14/564,291, filed Dec. 9, 2014.

(Continued)

*Primary Examiner* — David Gray
*Assistant Examiner* — Geoffrey T Evans
(74) *Attorney, Agent, or Firm* — Duft Bornsen & Fettig LLP

(57) ABSTRACT

A fixing device includes: a fixing member; an opposing member that provides a fixing nip with the fixing member; a heating unit that heats the fixing member; a heating area changing member that moves to change a heating area of the fixing member heated by the heating unit; and a position detection sensor that detects a position of the heating area changing member. The fixing device controls a stop position of the heating area changing member based on detection by the position detection sensor. The single position detection sensor detects the position of the heating area changing member both when the heating area changing member is moving from a preset reference position to an arbitrary position and when the heating area changing member is moving back from an arbitrary position to the reference position.

11 Claims, 13 Drawing Sheets

(56) References Cited

U.S. PATENT DOCUMENTS

| | | | | |
|---|---|---|---|---|
| 2014/0079453 | A1 | 3/2014 | Arai et al. | |
| 2014/0079455 | A1 | 3/2014 | Seki et al. | |
| 2014/0248072 | A1 | 9/2014 | Yoshinaga et al. | |
| 2014/0270820 | A1 | 9/2014 | Saito et al. | |
| 2014/0270831 | A1* | 9/2014 | Yoshinaga ..... | G03G 15/2039 399/67 |
| 2014/0270832 | A1 | 9/2014 | Saito et al. | |
| 2014/0270833 | A1 | 9/2014 | Yuasa et al. | |
| 2014/0270872 | A1 | 9/2014 | Tamaki et al. | |
| 2014/0270875 | A1 | 9/2014 | Mimbu et al. | |
| 2014/0294456 | A1 | 10/2014 | Ueno et al. | |
| 2014/0294461 | A1 | 10/2014 | Tokuda et al. | |
| 2014/0341623 | A1 | 11/2014 | Arai et al. | |
| 2014/0341624 | A1 | 11/2014 | Arai et al. | |
| 2014/0341625 | A1 | 11/2014 | Imada et al. | |
| 2014/0341626 | A1 | 11/2014 | Mimbu et al. | |
| 2014/0341627 | A1 | 11/2014 | Yoshikawa et al. | |
| 2014/0356036 | A1 | 12/2014 | Shimokawa et al. | |
| 2014/0356037 | A1 | 12/2014 | Shimokawa et al. | |
| 2014/0356038 | A1 | 12/2014 | Arai et al. | |
| 2015/0078770 | A1 | 3/2015 | Yamano et al. | |
| 2015/0098738 | A1 | 4/2015 | Arai et al. | |
| 2015/0104227 | A1 | 4/2015 | Shimokawa et al. | |
| 2015/0116718 | A1 | 4/2015 | Ochi et al. | |

FOREIGN PATENT DOCUMENTS

| | | |
|---|---|---|
| JP | 2013-178511 | 9/2013 |
| JP | 2014-059332 | 4/2014 |

OTHER PUBLICATIONS

U.S. Appl. No. 14/657,406, filed Mar. 13, 2015.
U.S. Appl. No. 14/657,656, filed Mar. 13, 2015.
U.S. Appl. No. 14/644,903, filed Mar. 11, 2015.
U.S. Appl. No. 14/644,124, filed Mar. 10, 2015.
U.S. Appl. No. 14/584,728, filed Dec. 29, 2014.

* cited by examiner

FIXING DEVICE OF AN IMAGE FORMING APPARATUS THAT UTILIZES EDGE DETECTIONS FOR HEAT SHIELD POSITIONAL DETERMINATIONS

CROSS-REFERENCE TO RELATED APPLICATIONS

The present application claims priority to and incorporates by reference the entire contents of Japanese Patent Application No. 2014-156575 filed in Japan on Jul. 31, 2014.

BACKGROUND OF THE INVENTION

1. Field of the Invention

The present invention relates to a fixing device that fixes an image to a recording medium, and an image forming apparatus including the fixing device.

2. Description of the Related Art

There is a known fixing device that is provided in an image forming apparatus, such as a copier or a printer, and that includes a heating area changing member capable of moving to change a heating area of a fixing member, such as a fixing roller or a fixing belt, heated by a heating unit.

The fixing device including the heating area changing member as described above may be provided with a position detection sensor that detects a position of the heating area changing member in order to improve the accuracy of a stop position of the heating area changing member in a moving destination.

For example, Japanese Patent Application Laid-open No. 2014-59332 proposes a device including two position detection sensors in order to control a movement stop position of a heating area changing member (shielding member). One of the two position detection sensors is used as an initial position detecting means for detecting the initial position of the heating area changing member, and the other is used as a position detecting means for detecting a position of the heating area changing member different from the initial position.

As described above, with use of the two position detection sensors, it is possible to improve the positional accuracy at the initial position and a moving destination different from the initial position of the heating area changing member. However, there is a demand for a reduction in the size and cost of the image forming apparatus, and therefore, there is a need to reduce the size and cost of the fixing device. To realize the reduction in the size and cost, it is desirable to control the position of the heating area changing member accurately with as small number of sensors as possible.

SUMMARY OF THE INVENTION

It is an object of the present invention to at least partially solve the problems in the conventional technology.

A fixing device includes: a fixing member; an opposing member that provides a fixing nip with the fixing member; a heating unit that heats the fixing member; a heating area changing member that moves to change a heating area of the fixing member heated by the heating unit; and a position detection sensor that detects a position of the heating area changing member. The fixing device controls a stop position of the heating area changing member based on detection by the position detection sensor. The single position detection sensor detects the position of the heating area changing member both when the heating area changing member is moving from a preset reference position to an arbitrary position and when the heating area changing member is moving back from an arbitrary position to the reference position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
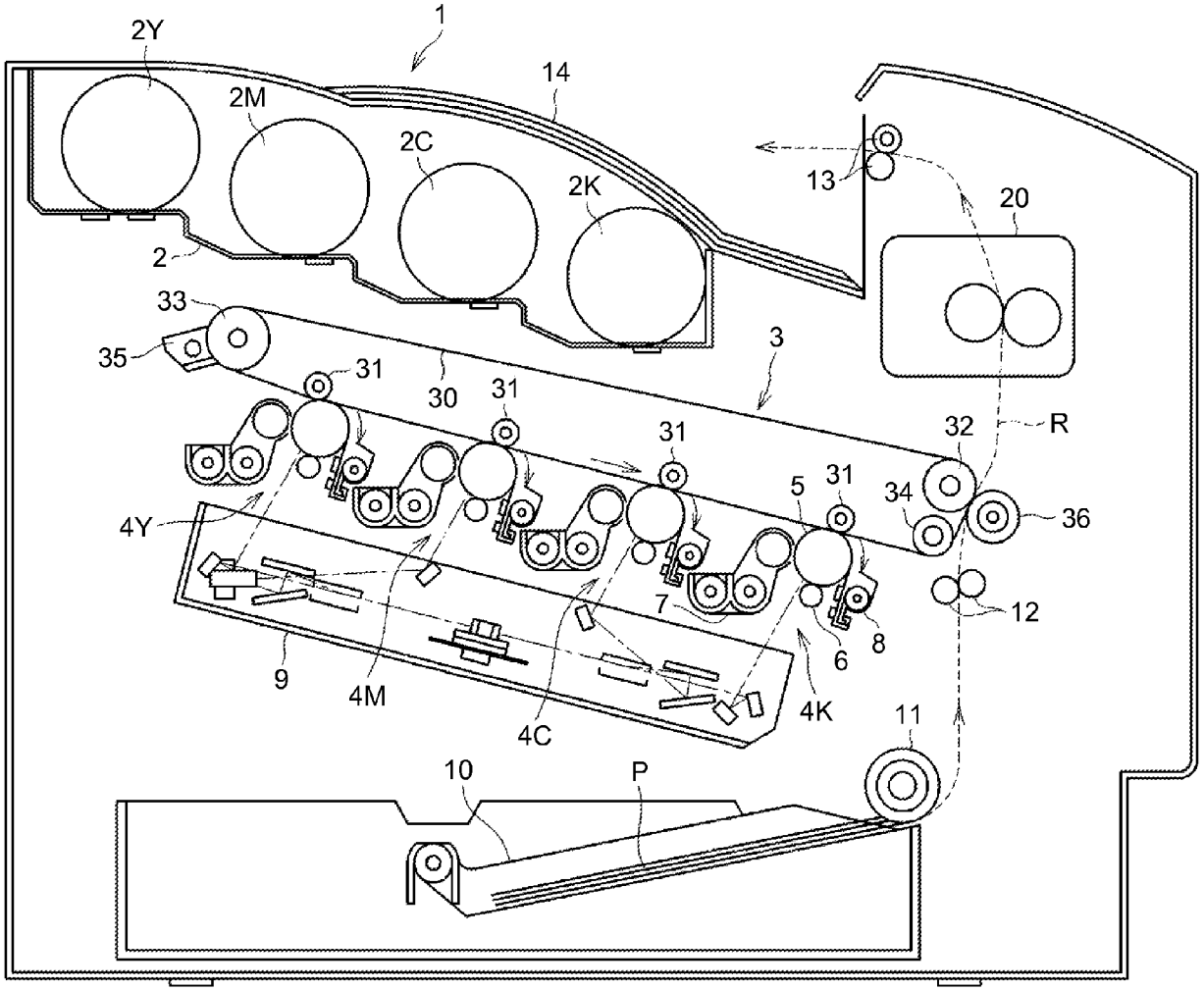
FIG. 1 is a schematic diagram of an entire configuration of an image forming apparatus according to an embodiment of the present invention.

Exemplary embodiments of the present invention will be described below with reference to the accompanying drawings. In the drawings for explaining the embodiments of the present invention, elements, such as parts or components, with the same functions or the same shapes will be denoted by the same reference signs as long as they are identifiable, and the same explanation will not be repeated.

With reference to FIG. 1, the entire configuration and operation of an image forming apparatus according to an embodiment of the present invention will be described.

An image forming apparatus 1 illustrated in FIG. 1 is a color laser printer, and includes four image formation units 4Y, 4M, 4C, and 4K in the center of a main body of the apparatus. The image formation units 4Y, 4M, 4C, and 4K have the same configuration except that they contain developers of different colors of yellow (Y), magenta (M), cyan (C), and black (K) corresponding to color components of a color image.

Specifically, each of the image formation units 4Y, 4M, 4C, and 4K includes a drum-shaped photoconductor 5 serving as a latent image bearer, a charging device 6 that charges a surface of the photoconductor 5, a developing device 7 that supplies toner to the surface of the photoconductor 5, and a cleaning device 8 that cleans the surface of the photoconductor 5. In FIG. 1, reference signs are appended to only the photoconductor 5, the charging device 6, the developing device 7, and the cleaning device 8 included in the image formation unit 4K for black, and the reference signs are omitted in the other image formation units 4Y, 4M, and 4C.

An exposure device 9 that exposes the surface of the photoconductor 5 is arranged below the image formation units 4Y, 4M, 4C, and 4K. The exposure device 9 includes a light source, a polygon mirror, an f-θ lens, and a reflecting mirror, and irradiates the surface of each of the photoconductors 5 with a laser beam based on image data.

A transfer device 3 is arranged above the image formation units 4Y, 4M, 4C, and 4K. The transfer device 3 includes an intermediate transfer belt 30 as an intermediate transfer medium, four primary-transfer rollers 31 as primary-transfer means, a secondary transfer roller 36 as a secondary-transfer means, a secondary-transfer backup roller 32, a cleaning backup roller 33, a tension roller 34, and a belt cleaning device 35.

The intermediate transfer belt 30 is an endless belt extended around the secondary-transfer backup roller 32, the cleaning backup roller 33, and the tension roller 34. The intermediate transfer belt 30 moves around (rotates) in the direction of arrow in the figure, along with the rotation of the secondary-transfer backup roller 32.

The four primary-transfer rollers 31 and the photoconductors 5 sandwich the intermediate transfer belt 30 and form respective primary-transfer nips. A power supply (not illustrated) is connected to each of the primary-transfer rollers 31 and applies a predetermined direct-current (DC) voltage and/or a predetermined alternating-current (AC) voltage to each of the primary-transfer rollers 31.

The secondary transfer roller 36 and the secondary-transfer backup roller 32 sandwich the intermediate transfer belt 30 and form a secondary-transfer nip. Similarly to the primary-transfer rollers 31 as described above, a power supply (not illustrated) is connected to the secondary transfer roller 36 and applies a predetermined DC voltage and/or a predetermined AC voltage to the secondary transfer roller 36.

The belt cleaning device 35 includes a cleaning brush and a cleaning blade that are disposed so as to come in contact with the intermediate transfer belt 30. A waste toner transfer hose (not illustrated) extending from the belt cleaning device 35 is connected to an inlet port of a waste toner container (not illustrated).

A bottle housing 2 is provided in the upper part of the main body of the printer, and four toner bottles 2Y, 2M, 2C, and 2K containing toner to be supplied are detachably attached to the bottle housing 2. Supply paths (not illustrated) are provided between the toner bottles 2Y, 2M, 2C, and 2K and the developing devices 7, and the toner is supplied from the toner bottles 2Y, 2M, 2C, and 2K to the developing devices 7 through the supply paths.

The printer is also provided with a sheet feeding tray 10 in which sheets P as recording media are stored, a sheet feeding roller 11 for taking out a sheet P from the sheet feeding tray 10, and the like in the lower part of the main body. Examples of the recording media include plain paper, thick paper, a postcard, an envelope, thin paper, coated paper (such as coat paper and art paper), tracing paper, and an overhead projector (OHP) sheet. It may be possible to provide a manual sheet feeder (not illustrated).

In the main body of the printer, a conveying path R is provided to convey the sheet P from the sheet feeding tray 10 through the secondary-transfer nip and discharge the sheet P to the outside of the apparatus. In the conveying path R, a registration roller pair 12, which serves as timing rollers for conveying the sheet P to the secondary-transfer nip while controlling the conveying timing, is provided upstream of the secondary transfer roller 36 in the sheet conveying direction.

A fixing device 20 is disposed downstream of the secondary transfer roller 36 in the sheet conveying direction to fix an unfixed image transferred to the sheet P. A pair of ejection rollers 13 is disposed downstream of the fixing device 20 in the sheet conveying direction in the conveying path R to discharge the sheet to the outside of the apparatus. In the embodiment, a part of the top surface of the main body of the printer serves as a sheet ejection tray 14 to stock sheets discharged to the outside of the apparatus by the sheet ejection rollers 13.

With reference to FIG. 1, a basic operation of the printer according to the embodiment will be described.

When an image formation operation starts, the photoconductors 5 in the respective image formation units 4Y, 4M, 4C, and 4K are driven to rotate clockwise in the figure by a driving device (not illustrated), and the charging devices 6 uniformly charges the respective surfaces of the photoconductors 5 with a predetermined polarity. The charged surfaces of the photoconductors 5 are irradiated with laser beams from the exposure device 9, and electrostatic latent images are formed on the respective surfaces of the photoconductors 5. Image information exposed to each of the photoconductors 5 at this time is image information on a single color that is obtained by resolving a desired full-color image into pieces of information on yellow, magenta, cyan, and black. The developing devices 7 supply toner to the electrostatic latent images formed on the respective photoconductors 5, and the electrostatic latent images are developed into toner images (visible images).

Further, when the image formation operation starts, the secondary-transfer backup roller 32 rotates counterclockwise in the figure and causes the intermediate transfer belt 30 to move around in the direction of arrow in the figure. A constant voltage with the polarity opposite to the charging polarity of the toner or a voltage with constant current control is applied to each of the primary-transfer rollers 31, so that a transfer electric field is formed in the primary-transfer nip between each of the primary-transfer rollers 31 and each of the photoconductors 5.

When the toner images of the respective colors on the photoconductors 5 reach the primary-transfer nips along with the rotation of the photoconductors 5, the toner images on the photoconductors 5 are sequentially transferred to the intermediate transfer belt 30 in a superimposed manner due to the transfer electric fields formed in the primary-transfer nips. Consequently, a full-color toner image is borne on the surface of the intermediate transfer belt 30. The toner remaining on each of the photoconductors 5 without being transferred to the intermediate transfer belt 30 is removed by the cleaning device 8. The surface of each of the photoconductors 5 is neutralized by a neutralizing device (not illustrated), and the surface potential is initialized.

In the lower part of the printer, the sheet feeding roller 11 starts to rotate, and a sheet P is fed from the sheet feeding tray 10 to the conveying path R. Conveyance of the sheet P fed to the conveying path R is temporarily stopped by the registration roller pair 12.

Thereafter, the registration roller pair 12 starts to rotate at a predetermined timing to convey the sheet P to the secondary-transfer nip in synchronization with a timing at which the toner image on the intermediate transfer belt 30 reaches the secondary-transfer nip. At this time, a transfer voltage with the polarity opposite to the charging polarity of the toner of the toner image on the intermediate transfer belt 30 is applied to the secondary transfer roller 36, and a transfer electric field is formed in the secondary-transfer nip. With the transfer electric field, the toner image on the intermediate transfer belt 30 is collectively transferred to the sheet P. Residual toner remaining on the intermediate transfer belt 30 without being transferred to the sheet P is removed by the belt cleaning device 35, and the removed toner is collected to the waste toner container (not illustrated).

Thereafter, the sheet P is conveyed to the fixing device 20, and the fixing device 20 fixes the toner image on the sheet P to the sheet P. The sheet P is discharged to the outside of the apparatus by the sheet ejection rollers 13 and stocked on a sheet ejection tray 14.

While the image formation operation for forming a full-color image on a sheet is described above, it may be possible to form a single-color image by using one of the four image formation units 4Y, 4M, 4C, and 4K or to form a two-color or three-color image by using two or three image formation units.

Figure 2:
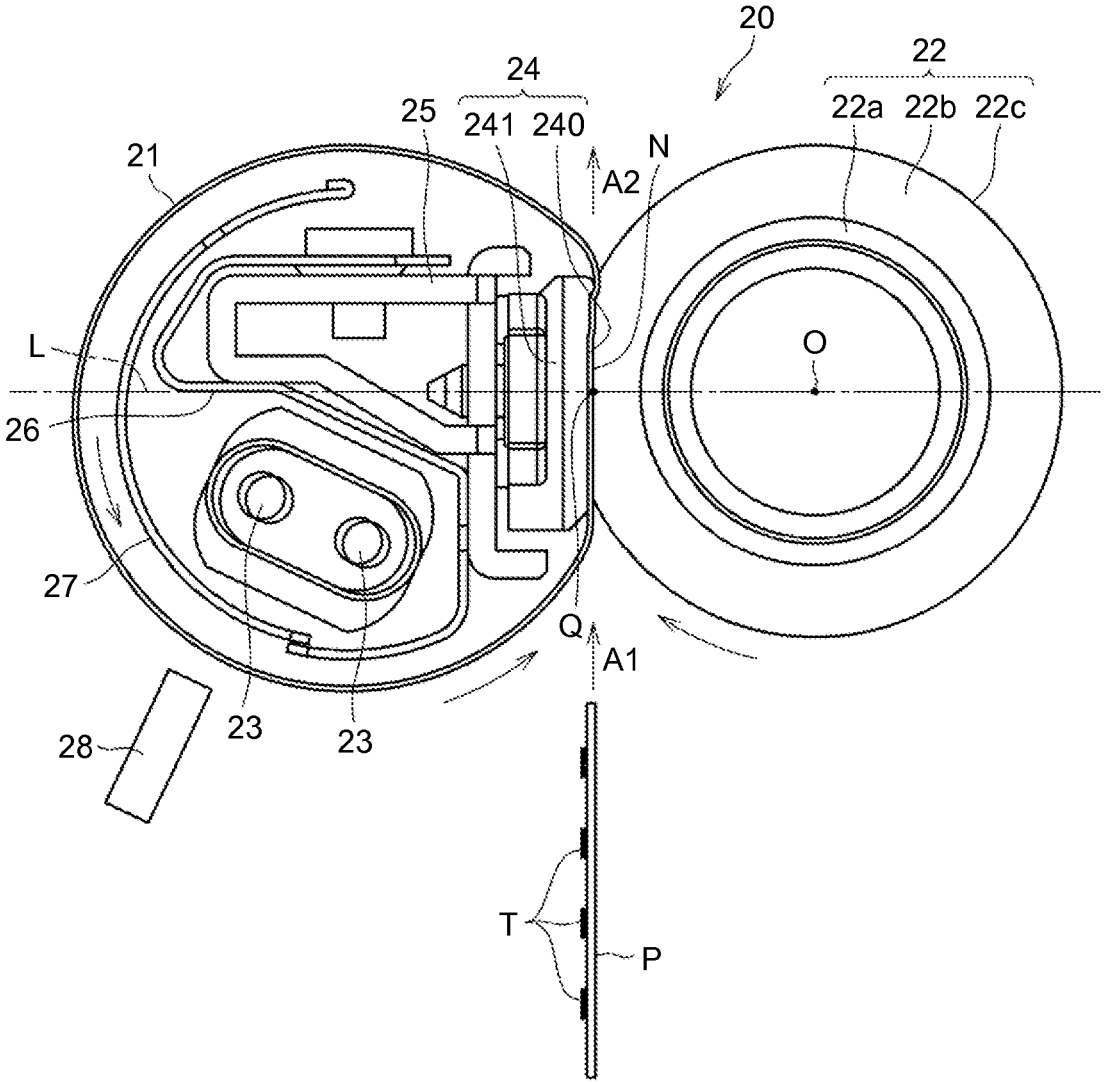
FIG. 2 is a schematic diagram of a configuration of a fixing device provided in the image forming apparatus.

FIG. 2 is a cross-sectional view of the fixing device of the embodiment.

A configuration of the fixing device 20 will be described below with reference to FIG. 2.

As illustrated in FIG. 2, the fixing device 20 includes a fixing belt 21 as a fixing member, a pressurizing roller 22 as an opposing member that provides a fixing nip N with the fixing belt 21, halogen heaters 23 as a heating unit for heating the fixing belt 21, a nip forming member 24 that supports the inner peripheral side of the fixing belt 21 at a position facing the pressurizing roller 22, a stay 25 as a supporting member for supporting the nip forming member 24, a reflecting member 26 that reflects heat from the halogen heaters 23 to the fixing belt 21, a heating area changing member 27 that changes a heating area of the fixing belt 21 heated by the halogen heaters 23, and a temperature sensor 28 as a temperature detecting unit for detecting a temperature of the fixing belt 21.

The fixing belt 21 is configured with a thin endless belt member (including a film) with the flexibility. Specifically, the fixing belt 21 is configured with an inner base material made of a metal material, such as nickel or stainless steel (SUS), or a resin material, such as polyimide (PI), and an outer release layer made of tetrafluoroethylene-perfluoroalkyl vinyl ether copolymer (PFA) or polytetrafluoroethylene (PTFE). An elastic layer made of a rubber material, such as silicone rubber, foamed silicone rubber, or fluoro-rubber, may be interposed between the base material and the release layer.

If the elastic layer is not provided, the heat capacity is reduced and the fixability is improved. However, minute irregularities on the surface of the belt may be transferred to an image when unfixed toner is fixed by pressing, and gloss irregularities may occur in a solid portion of the image. To prevent this, it is preferable to provide an elastic layer with a thickness of 100 μm or greater. By providing the elastic layer with a thickness of 100 μm or greater, the minute irregularities can be absorbed by the elastic deformation of the elastic layer, and occurrence of gloss irregularities can be prevented.

In the embodiment, to reduce the heat capacity of the fixing belt 21, the fixing belt 21 is made thin and the diameter thereof is reduced. Specifically, the thicknesses of the base material, the elastic layer, and the release layer of the fixing belt 21 are set to within ranges of 20 to 50 μm, 100 to 300 μm, and 10 to 50 μm, respectively, and the overall thickness is set to 1 mm or smaller. The diameter of the fixing belt 21 is set to 20 to 40 mm. To further reduce the heat capacity, it is preferable to set the overall thickness of the fixing belt 21 to 0.2 mm or smaller, and more preferably, to 0.16 mm or smaller. Further, it is preferable to set the diameter of the fixing belt 21 to 30 mm or smaller.

The pressurizing roller 22 includes a cored bar 22*a*, an elastic layer 22*b* that is made of foamed silicone rubber, silicone rubber, fluoro-rubber, or the like and provided on the surface of the cored bar 22*a*, and a release layer 22*c* that is made of PFA, PTFE, or the like and provided on the surface of the elastic layer 22*b*. The pressurizing roller 22 is pressurized toward the nip forming member 24 by a pressurizing means (not illustrated), and is pressed against the fixing belt 21. At a portion where the pressurizing roller 22 and the fixing belt 21 are pressed against each other, the elastic layer 22*b* of the pressurizing roller 22 is flattened, and the fixing nip N with a predetermined width is formed. The fixing member and the opposing member do not necessarily have to be pressed against each other. These members may be simply brought into contact with each other rather than being pressed against, as long as the predetermined fixing nip N can be formed.

The pressurizing roller 22 is configured to be rotated by a driving source (not illustrated), such as a motor, provided in the main body of the printer. With the rotation of the pressurizing roller 22, the driving force is transmitted to the fixing belt 21 at the fixing nip N, and the fixing belt 21 is rotated.

In the embodiment, the pressurizing roller 22 is a solid roller; however, it may be a hollow roller. In this case, a heat source, such as a halogen heater, may be disposed inside the pressurizing roller 22. The elastic layer 22*b* may be made with solid rubber, or may be made with sponge rubber if the heat source is not provided inside the pressurizing roller 22. Sponge rubber is more preferable because the heat insulating property is improved and the heat of the fixing belt 21 is less likely to be lost.

The halogen heaters 23 are disposed inside the inner peripheral side of the fixing belt 21 and upstream of the fixing nip N in the sheet conveying direction. Specifically, in FIG. 2, assuming that an imaginary line L passing through a center Q of the fixing nip N in the sheet conveying direction and passing through a rotation center O of the pressurizing roller 22 is provided, the halogen heaters 23 are disposed upstream (lower in FIG. 2) relative to the imaginary line L in the sheet conveying direction. The halogen heaters 23 are configured to generate heat by being subjected to output control by a power supply unit provided in the main body of the printer, and the output control is performed based on a result of detection of the surface temperature of the fixing belt 21 by the temperature sensor 28. Through the output control of the halogen heaters 23, the temperature of the fixing belt 21 (a fixing temperature) is set to a desired temperature. It may be possible to provide a temperature sensor (not illustrated) for detecting the temperature of the pressurizing roller 22, instead of the temperature sensor that detects the temperature of the fixing belt 21, and estimate the temperature of the fixing belt 21 from the temperature detected by the provided temperature sensor.

While the two halogen heaters 23 are provided in the embodiment, the number of the halogen heaters 23 may be one or three or more depending on the size of a sheet used by the printer, and/or the like. An induction heating (IH) coil, a resistance heating element, a carbon heater, or the like may be used as the heat source for heating the fixing belt 21, instead of the halogen heater.

The nip forming member 24 includes a base pad 241 and a low-frictional sliding sheet 240 provided on the surface of the base pad 241 facing the fixing belt 21. The base pad 241 is formed in an elongated shape extending along the axial direction of the fixing belt 21 or the axial direction of the pressurizing roller 22. The base pad 241 receives a pressurizing force of the pressurizing roller 22, and the shape of the fixing nip N is determined accordingly. While the fixing nip N has a flat shape in the embodiment, a concave shape or other shapes may be employed. By providing the sliding sheet 240 on the surface of the base pad 241 facing the fixing belt 21, sliding friction due to the rotation of the fixing belt 21 can be reduced. If the base pad 241 is made of a low frictional material, the sliding sheet 240 may be omitted.

The base pad 241 is configured with a heat-resistant material with a heat resistant temperature of 200° C. or higher, prevents deformation of the nip forming member 24 due to heat in a temperature range for fixing toner, and ensures the stability of the fixing nip N, thereby ensuring the stable quality of output images. As the material of the base pad 241, common heat resistant resin, such as polyethersulfone (PES), polyphenylene sulfide (PPS), liquid crystal polymer (LCP), polyether nitrile (PEN), polyamide imide (PAI), or polyether etherketone (PEEK) may be used.

The base pad 241 is fixedly supported by the stay 25. This prevents deflection of the nip forming member 24 due to the pressure of the pressurizing roller 22, and enables a uniform nip width along the axial direction of the pressurizing roller 22 to be obtained. It is preferable to form the stay 25 with a metal material with high mechanical strength, such as stainless or iron, in order to fulfil a deflection preventing function of the nip forming member 24. It is also preferable to form the base pad 241 with a relatively hard material in order to ensure the strength. Examples of the material applicable to the base pad 241 include resin, such as liquid crystal polymer (LCP), metal, and ceramic.

The reflecting member 26 is fixedly supported on the stay 25 so as to face the halogen heaters 23. The reflecting member 26 reflects radiation heat (or light) emitted from the halogen heaters 23 to the fixing belt 21 to prevent transmission of heat to the stay 25 or the like, efficiently heat the fixing belt 21, and save energy. As the material of the reflecting member 26, aluminum, stainless material, or the like is used. In particular, if a material in which silver with low emissivity (high reflectivity) is deposited on a base material made of aluminum by vapor deposition is used, the heating efficiency of the fixing belt 21 can be improved.

Figure 3:
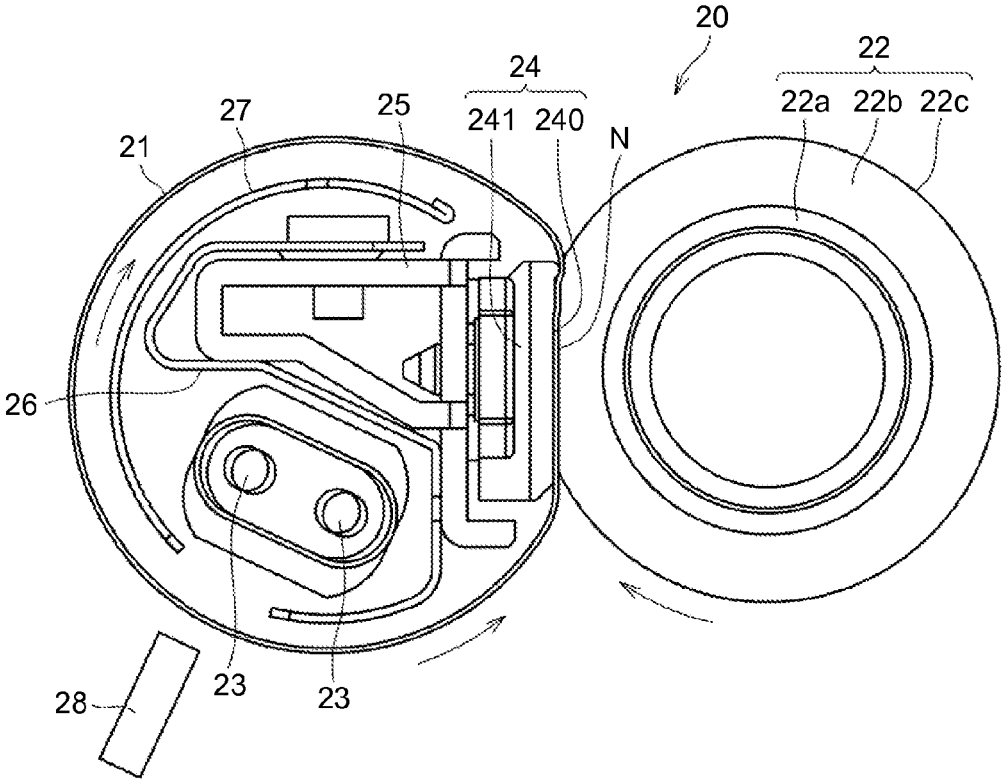
FIG. 3 is a diagram illustrating a state in which a heating area changing member is moved to a retracted position.

The heating area changing member 27 is made by shaping a metal plate with a thickness of 0.1 to 1.0 mm to have an arc-shaped cross-section along the inner surface of the fixing belt 21. The heating area changing member 27 can move in the circumferential direction of the fixing belt 21 if needed. In the embodiment, a circumferential area of the fixing belt 21 includes a direct heating area, in which the halogen heaters 23 directly face and heat the fixing belt 21, and a non-direct heating area, in which members (the reflecting member 26, the stay 25, and the nip forming member 24) other than the heating area changing member 27 are interposed between the halogen heaters 23 and the fixing belt 21. If heat shielding is needed, as illustrated in FIG. 2, the heating area changing member 27 is disposed at a shielding position at the direct heating area. In contrast, if heat shielding is not needed, as illustrated in FIG. 3, the heating area changing member 27 can be moved to a retracted position at the non-direct heating area to retract the heating area changing member 27 to the backside of the reflecting member 26 and the stay 25. The heating area changing member 27 needs to have heat-resistant property; therefore, it is preferable to use a metal material, such as aluminum, iron, or stainless material, or ceramic, as the material thereof.

With reference to FIG. 2, a basic operation of the fixing device according to the embodiment will be described.

When a power switch of the main body of the printer is turned on, electric power is supplied to the halogen heaters 23 and the pressurizing roller 22 starts to rotate clockwise in FIG. 2. Therefore, the fixing belt 21 is rotated counterclockwise in FIG. 2 due to a frictional force with the pressurizing roller 22.

Thereafter, the sheet P bearing an unfixed toner image T formed through the above-described image formation process is conveyed in the direction of arrow A1 in FIG. 2 by being guided by a guide plate (not illustrated), and fed to the fixing nip N between the fixing belt 21 and the pressurizing roller 22 that are pressed against each other. With the heat of the fixing belt 21 heated by the halogen heaters 23 and a pressurizing force between the fixing belt 21 and the pressurizing roller 22, the toner image T is fixed to the surface of the sheet P.

The sheet P with the fixed toner image T is discharged in the direction of arrow A2 in FIG. 2 from the fixing nip N. At this time, a leading end of the sheet P comes in contact with a tip of a separation member (not illustrated), and the sheet P is separated from the fixing belt 21. The separated sheet P is discharged to the outside of the apparatus by the sheet ejection roller and stocked on the sheet ejection tray as described above.

Figure 4:
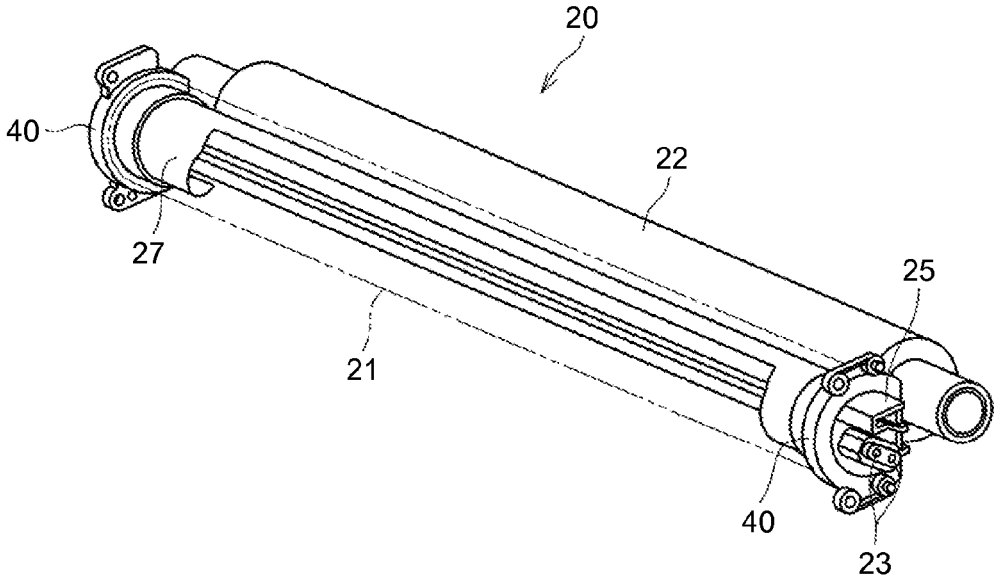
FIG. 4 is a perspective view of the fixing device.

FIG. 4 is a perspective view of the fixing device of the embodiment.

As illustrated in FIG. 4, flange members 40 serving as belt holders are inserted in both ends of the fixing belt 21, and the fixing belt 21 is rotatably held by the flange members 40. The halogen heaters 23 and the stay 25 are fixedly supported on a pair of side plates (not illustrated) of the fixing device 20, in addition to the flange members 40.

Figure 5:
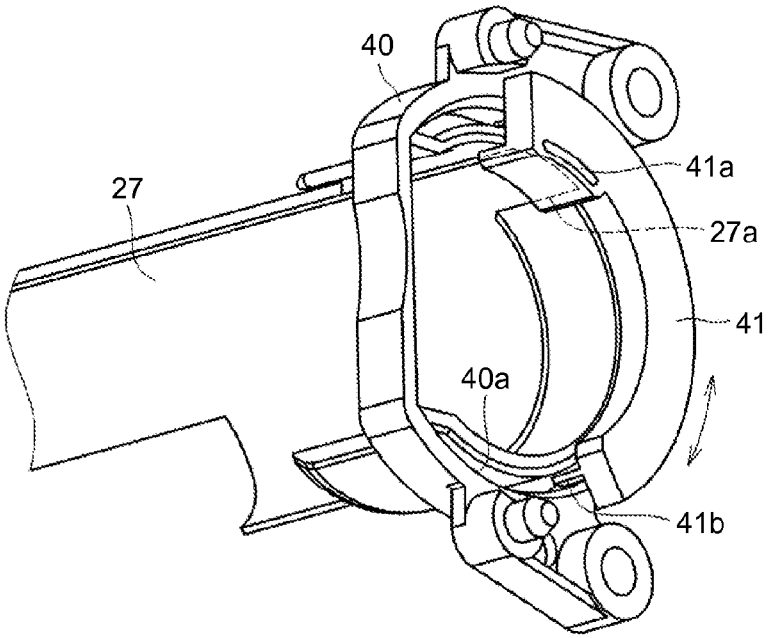
FIG. 5 is a diagram illustrating a support structure of the heating area changing member.

FIG. 5 is a diagram illustrating a support structure of the heating area changing member.

As illustrated in FIG. 5, the heating area changing member 27 is supported via an arc-shaped sliding member 41 attached to the flange members 40. Specifically, the heating area changing member 27 is attached to the sliding member 41 by inserting a protrusion 27*a* provided on an end portion of the heating area changing member 27 in a hole 41*a* provided on the sliding member 41. The sliding member 41 further includes a protrusion 41*b* and the protrusion 41*b* is inserted in an arc-shaped groove 40*a* provided on the flange members 40 such that the sliding member 41 can move in a sliding manner along the groove 40*a*. Therefore, the heating area changing member 27 can rotationally move in the circumferential direction of the flange members 40 integrally with the sliding member 41. In the embodiment, the flange members 40 and the sliding member 41 are made of resin.

In FIG. 5, only the support structure at one end portion of the heating area changing member 27 is illustrated; however, the other end portion is also held in a rotationally movable manner via the sliding member 41.

Figure 6:
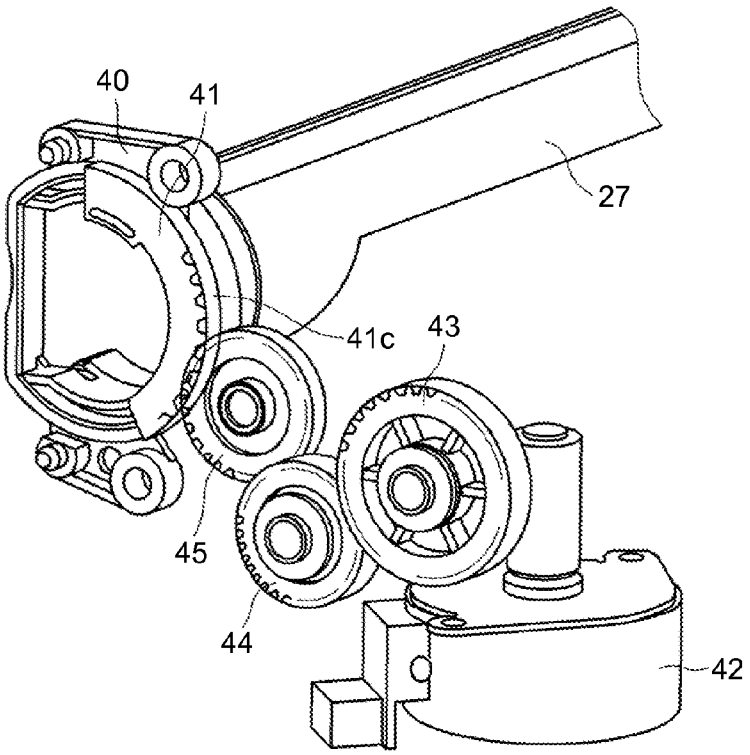
FIG. 6 is a diagram illustrating a driving means of the heating area changing member.

FIG. 6 is a diagram illustrating a driving means of the heating area changing member.

As illustrated in FIG. 6, in the embodiment, as the driving means of the heating area changing member 27, a motor 42 serving as a driving source and a gear train including a plurality of transmission gears 43, 44, and 45 is provided. In the gear train, the gear 43 on one end is connected to the motor 42, and the gear 45 on the other end is connected to a gear portion 41*c* provided in the circumferential direction of the sliding member 41. Therefore, when the motor 42 drives, the driving force is transmitted to the sliding member 41 via the gear train and the heating area changing member 27 rotationally moves.

Figure 7:
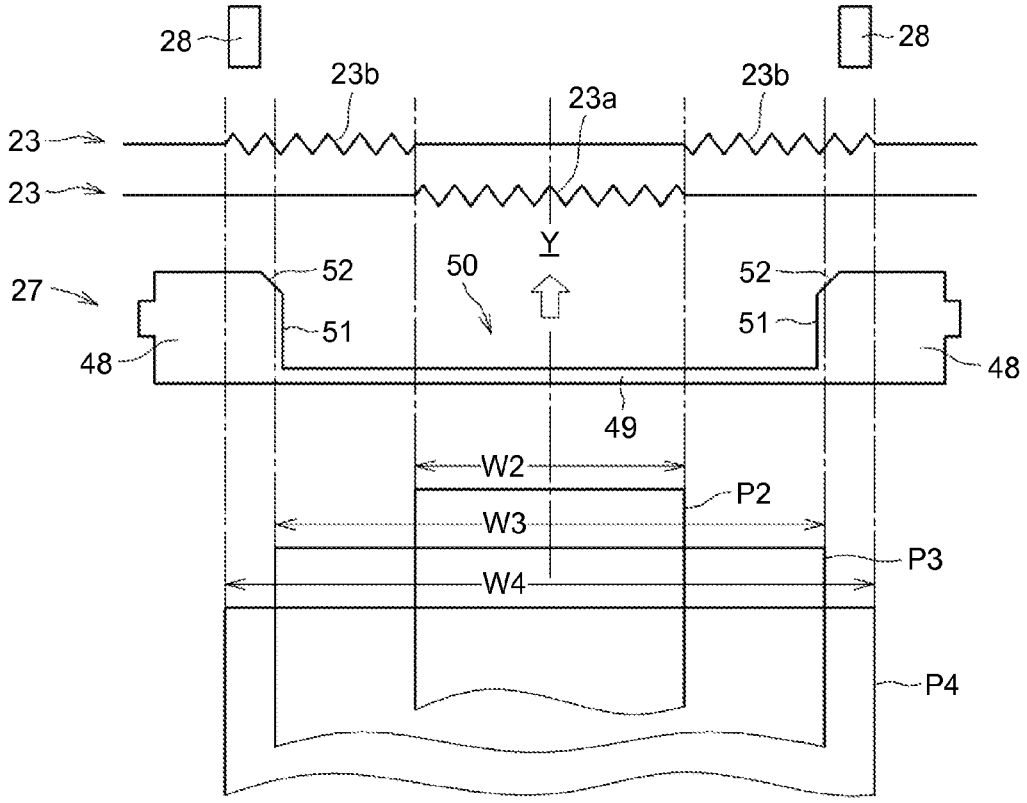
FIG. 7 is a diagram illustrating a relationship among a shape of the heating area changing member, a heat generating part of a halogen heater and a sheet size.

FIG. 7 is a diagram illustrating a relationship among a shape of the heating area changing member, a heat generating part of a halogen heater and a sheet size.

First, the shape of the heating area changing member 27 will be described in detail below based on FIG. 7.

As illustrated in FIG. 7, the heating area changing member 27 of the embodiment includes a pair of shielding portions 48 provided on both ends thereof to block heat from the halogen heaters 23, and a connecting portion 49 connecting the shielding portions 48. The connecting portion 49 is thinner than the shielding portions 48. Therefore, a portion where the connecting portion 49 is not provided between the shielding portions 48 serves an opening 50 through which the heat from the halogen heaters 23 is emitted to the fixing belt 21 without being blocked.

On the inner edges of the shielding portions 48 facing each other, straight portions 51 parallel to the rotation direction of the heating area changing member 27, and inclined portions 52 inclined with respect to the rotation direction are provided. In FIG. 7, assuming that a direction in which the heating area changing member 27 rotationally moves to the shielding position is referred to as a shielding direction Y, the inclined portions 52 are provided continuously to the respective straight portions 51 in the shielding direction Y, and inclined so as to be separated from each other toward the shielding direction Y. Therefore, the opening 50 is provided such that the width between the straight portions 51 is constant and the width between the inclined portions 52 increases toward the shielding direction Y.

Next, the relationship between the heat generating part of the halogen heater and the sheet size will be described.

As illustrated in FIG. 7, in the embodiment, the length of the heat generating part of each of the halogen heaters 23 and the arrangement position are varied to change a heating area depending on the sheet size. A heat generating part 23*a* of one of the two halogen heaters 23 (in the lower in the figure) is arranged in the center in the longitudinal direction, and heat generating parts 23*b* of the other one of the halogen heaters 23 (in the upper in the figure) are arranged on both ends in the longitudinal direction. In this example, the heat generating part 23*a* in the center is arranged in a range corresponding to a sheet passing width W2 of a middle size, and the heat generating parts 23*b* on the both ends are arranged in a range greater than the sheet passing width W2 of the middle size and including a sheet passing width W3 of a large size and a sheet passing width W4 of an extra-large size.

In the relationship between the shape of the heating area changing member 27 and the sheet size, the straight portions 51 are arranged inside and in the vicinities of the respective ends of the sheet passing width W3 of the large size in the width direction, and the inclined portions 52 are arranged at positions crossing the respective ends of the sheet passing width W3 of the large size.

As examples of the sheet size in the embodiment, the middle size may be a letter size (a sheet passing width of 215.9 mm) or the A4 size (a sheet passing width of 210 mm), the large size may be a double letter size (a sheet passing width of 279.4 mm) or the A3 size (a sheet passing width of 297 mm), and the extra-large size may be the A3 plus size (a sheet passing width of 329 mm). However, the sheet size is not limited to these examples. The middle size, the large size, and the extra-large size described herein indicate relative relationships among all of the sizes, and they may be a small size, a middle size, and a large size.

Next, control of the halogen heater and control of the heating area changing member for each sheet size will be described.

When a middle size sheet P2 passes as illustrated in FIG. 7, only the heat generating part 23*a* in the center is made to generate heat to heat only the range corresponding to the sheet passing width W2 of the middle size. When an extra-large size sheet P4 passes, not only the heat generating part 23*a* in the center but also the heat generating parts 23*b* on the both ends are made to generate heat to heat the range corresponding to the sheet passing width W4 of the extra-large size. As described above, in the embodiment, by causing only the halogen heater 23 provided with the heat generating part 23*a* in the center to generate heat, or by further causing the halogen heater 23 provided with the heat generating parts 23*b* on the both ends to generate heat, heating areas corresponding to the sheet passing width W2 of the middle size and the sheet passing width W4 of the extra-large size can be obtained.

In contrast, when a large size sheet P3 passes, it is difficult to obtain a heating area corresponding to the sheet passing width W3 by only the two halogen heaters 23. Specifically, when the large size sheet P3 passes, if only the heat generating part 23*a* in the center is made to generate heat, the heating area is smaller than the sheet passing width W3 and a necessary range is not heated. If the heat generating part 23*a* in the center and the heat generating parts 23*b* on the both ends are made to generate heat, the heating area exceeds the sheet passing width W3 of the large size. In particular, if the large size sheets P3 are continuously fed while the heat generating part 23*a* in the center and the heat generating parts 23*b* on the both ends are made to generate heat, the temperature of the fixing belt 21 excessively increases in non-sheet passing areas outside the sheet passing width W3 of the large size.

Figure 8:
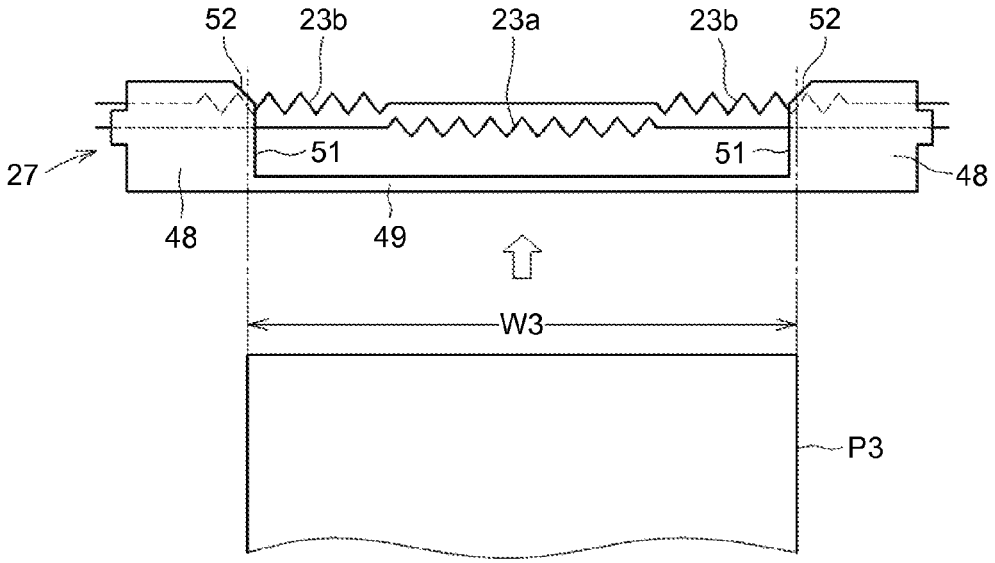
FIG. 8 is a diagram illustrating a state in which the heating area changing member is moved to a shielding position.

Therefore, in the embodiment, when the large size sheet P3 passes, as illustrated in FIG. 8, the heating area is adjusted to the sheet width size by using the heating area changing member 27. Specifically, while the heat generating part 23*a* in the center and the heat generating parts 23*b* on the both ends are made to generate heat, the heating area changing member 27 is moved from the retracted position illustrated in FIG. 7 to the shielding position illustrated in FIG. 8 such that the shielding portions 48 of the heating area changing member 27 cover parts of the heat generating parts 23*b* on the both ends. Consequently, the heating area is adjusted to the range corresponding to the sheet passing width W3 of the large size, and an increase in the temperature of the fixing belt 21 in the non-sheet passing areas can be prevented.

Thereafter, when heat shielding is not needed, such as after the fixing is finished or when the temperature of the fixing belt 21 in the non-sheet passing areas becomes equal to or lower than a predetermined threshold, the heating area changing member 27 is moved back to the retracted position. As described above, by moving the heating area changing member 27 to the shielding position as needed, it is possible to perform good fixing without decreasing the sheet passing speed.

In the embodiment, the inclined portions 52 are provided on the shielding portions 48. Therefore, by changing a movement stop position of the heating area changing member 27, it is possible to adjust the ranges of the heat generating parts 23*b* which are covered by the shielding portions 48. For example, if the number of fed sheets or a sheet passing time increases, the temperature of the fixing belt 21 in the non-sheet passing areas tends to increase. Therefore, if the number of fed sheets reaches a predetermined number or if the sheet passing time reaches a predetermined time, the heating area changing member 27 may be moved in the direction in which the heat generating parts 23*b* on the both ends are covered, making it possible to prevent an increase in the temperature more strongly.

In the embodiment, an increase in the temperature in the non-sheet passing areas is remarkable especially when the large size sheet P3 passes. Therefore, it is preferable to dispose the temperature sensors 28 at positions corresponding to areas outside the sheet passing width W3 of the large size (see FIG. 7). It is also preferable to arrange the temperature sensors 28 at positions facing the heat generating parts 23*b* on the both ends in the circumferential direction of the fixing belt 21 because the heat generating parts 23*b* mostly contribute to an increase in the temperature as described above.

Figure 9:
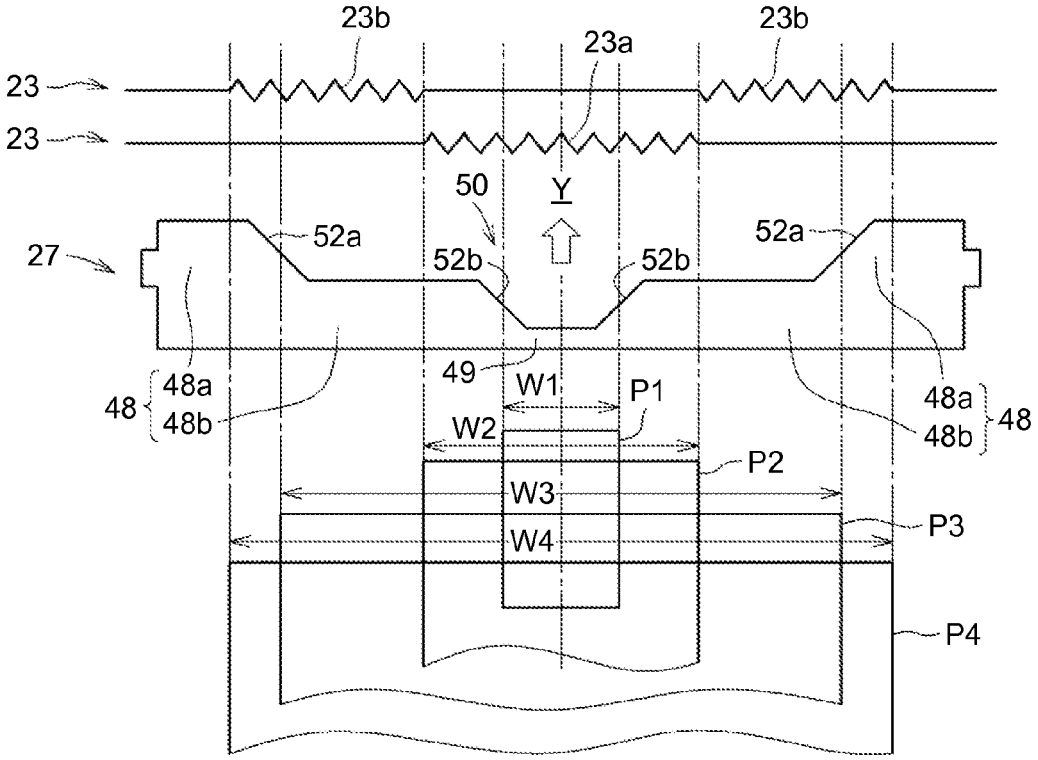
FIG. 9 is a diagram illustrating a configuration of a heating area changing member of another embodiment.

FIG. 9 illustrates another embodiment of the heating area changing member.

The heating area changing member 27 illustrated in FIG. 9 has a shape in which each of the shielding portions 48 on either end has two stepped portion. Specifically, each of the shielding portions 48 includes a small shielding portion 48*a* with a relatively small width in the longitudinal direction, and a large shielding portion 48*b* with a relatively large width in the longitudinal direction. The large shielding portions 48*b* are connected via the connecting portion 49, and the small shielding portions 48*a* are provided continuously to the respective large shielding portions 48*b* in the shielding direction Y. Opposing inner edges of the small shielding portions 48*a* and opposing inner edges of the large shielding portions 48*b* form inclined portions 52*a* and 52*b*, respectively, which are inclined so as to be separated from each other toward the shielding direction Y. In this example, the straight portions 51 of the heating area changing member 27 as illustrated in FIG. 7 are not provided.

In the embodiment illustrated in FIG. 9, at least four types of sheets of a small size sheet P1, the middle size sheet P2, the large size sheet P3, and the extra-large size sheet P4 are used. As examples of the sheet size in the embodiment, the small size may be a letter size (a sheet passing width of 100 mm), the middle size may be the A4 size (a sheet passing width of 210 mm), the large size may be the A3 size (a sheet passing width of 297 mm), and the extra-large size may be the A3 plus size (a sheet passing width of 329 mm). However, the sheet size is not limited to these examples.

A sheet passing width W1 of the small size sheet P1 is a range smaller than the length of the heat generating part 23*a* in the center. In terms of the relationship with the shape of the heating area changing member 27, the inclined portions 52*b* of the large shielding portions 48*b* are arranged at positions crossing the respective ends of the sheet passing width W1 of the small size, and the inclined portions 52*a* of the small shielding portions 48*a* are arranged at positions crossing the respective ends of the sheet passing width W3 of the large size. The positional relationships of the sheet sizes (medium, large, and extra-large) other than the small size and the heat generating parts 23*a* and 23*b* are the same as those of the above-described embodiment, and therefore, explanation thereof will not be repeated.

Figure 10:
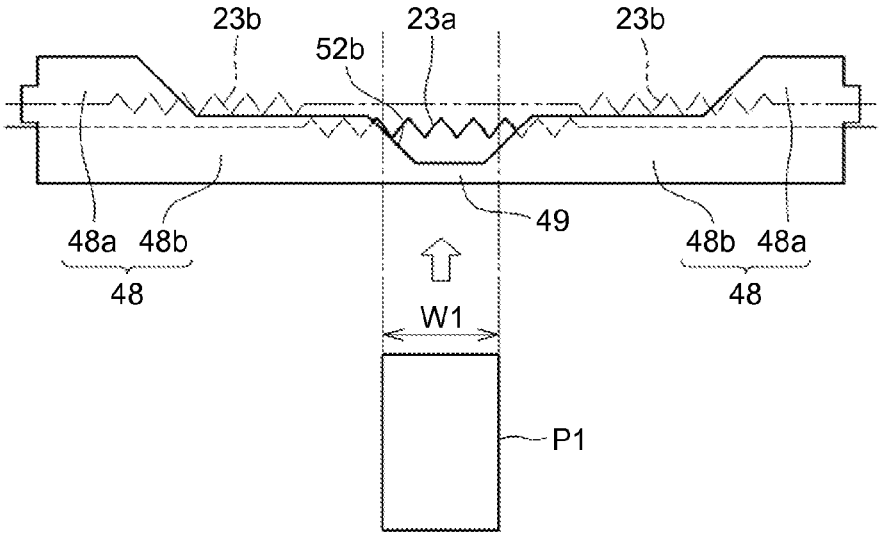
FIG. 10 is a diagram illustrating a state in which the heating area changing member is moved to the shielding position.

When the small size sheet P1 passes, only the heat generating part 23*a* in the center is made to generate heat. However, in this case, the range heated by the heat generating part 23*a* in the center exceeds the sheet passing width W1 of the small size. Therefore, as illustrated in FIG. 10, the heating area changing member 27 is moved to the shielding position. Consequently, the large shielding portions 48*b* cover the heat generating part 23*a* in the center over the ranges outside from the vicinities of the respective outer ends of the sheet passing width W1 of the small size, making it possible to prevent an increase in the temperature of the fixing belt 21 in the non-sheet passing areas.

The control of the halogen heaters 23 and the heating area changing member 27 when sheets of the other sizes (medium, large, and extra-large) pass is the same as that of the above-described embodiment. In this case, the small shielding portions 48*a* function as the shielding portions 48 of the above-described embodiment.

Even in the embodiment illustrated in FIG. 9, similarly to the shielding portions 48 of the above-described embodiment, the inclined portions 52*a* and 52*b* are provided on the small shielding portions 48*a* and the large shielding portions 48*b*, respectively. Therefore, it is possible to adjust the ranges of the heat generating parts 23*a* and 23*b* which are covered by the shielding portions 48*a* and 48*b* by changing the movement stop position of the heating area changing member 27.

In the embodiment, a synchronous motor, in particular, a stepping motor that has an advantage in costs and that is controllable in a relatively easy manner, is used as the driving source of the heating area changing member 27. By adjusting the pulse volume of the stepping motor, it is possible to adjust the moving distance of the heating area changing member 27 and control the stop position of the heating area changing member 27. It may be possible to use a DC motor, instead of the stepping motor.

The heating area changing member 27 is required to stop at a target position with accuracy. If the accuracy of the stop position of the heating area changing member 27 is reduced, the fixing belt 21 may not be adequately heated and image quality may be reduced. Alternatively, the fixing belt 21 may be excessively heated and temperature irregularity (temperature difference) may occur on the surface of the belt, so that the fixability may be reduced or the fixing belt may be deformed. Therefore, in the fixing device of the embodiments, a position detection sensor for detecting the position of the heating area changing member 27 is provided in order to improve the accuracy of the stop position of the heating area changing member 27.

Figure 11:
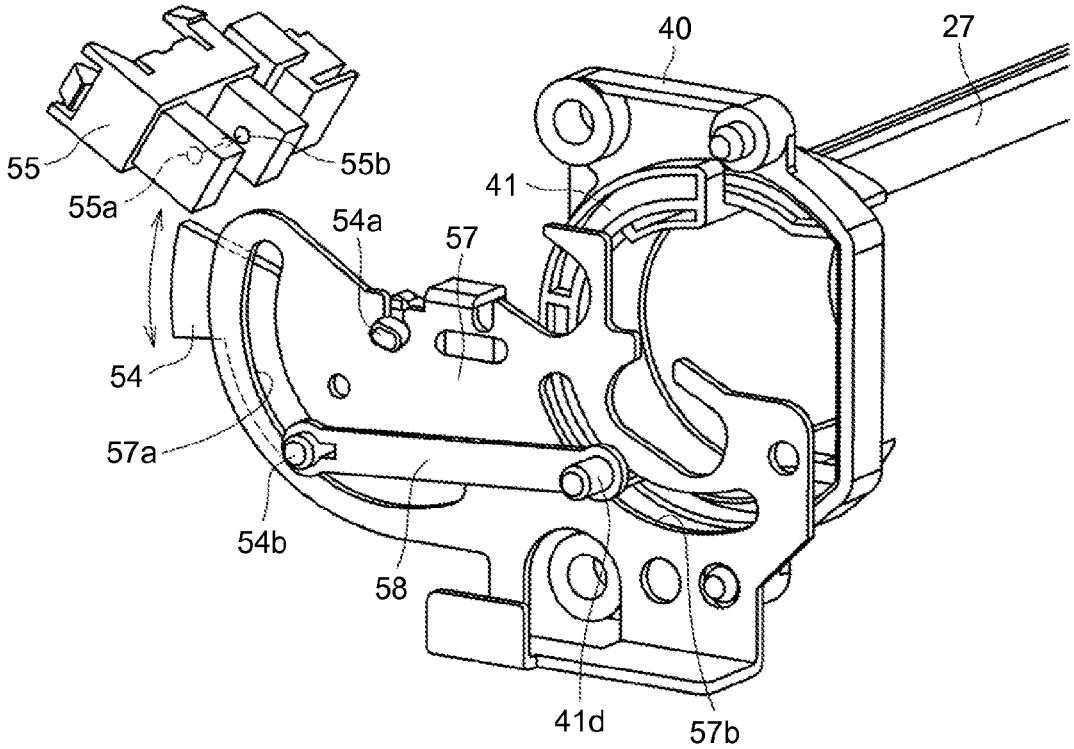
FIG. 11 is a diagram illustrating a configuration of a position detecting mechanism using a position detection sensor.

FIG. 11 is a diagram illustrating a configuration of a position detecting mechanism using a position detection sensor.

In the embodiment, a transmissive photo-interrupter 55 is used as a position detection sensor. The photo-interrupter 55 includes a light-emitting unit 55*a* consisting of a light-emitting diode or the like, and a light receiving unit 55*b* consisting of a photosensor or the like. The light-emitting unit 55*a* and the light receiving unit 55*b* are arranged opposite to each other such that the light-emitting unit 55*a* emits light toward the light receiving unit 55*b* and the light receiving unit 55*b* outputs a detection signal corresponding to the received intensity of the incident light.

The photo-interrupter 55 is configured to detect the position of the heating area changing member 27 via a filler 54 serving as a detected member that is displaced in accordance with the position of the heating area changing member 27. The filler 54 is supported by a supporting member 57, and is rotatable about a supporting point 54*a*.

The filler 54 is connected to the heating area changing member 27 via a link member 58 in an interlocking manner. One end portion of the link member 58 is connected to a protrusion 54*b* provided on the filler 54, and the other end portion is connected to a protrusion 41*d* provided on the sliding member 41. The protrusion 54*b* of the filler 54 and the protrusion 41*d* of the sliding member 41 are movable along arc-shaped slits 57*a* and 57*b* serving as guiding portions provided on the supporting member 57.

In the position detecting mechanism constructed as described above, when the heating area changing member 27 is to be moved, if the sliding member 41 moves along the flange member 40, the filler 54 rotates about the supporting point 54*a* along with the movement. If the filler 54 is interposed between the light-emitting unit 55*a* and the light receiving unit 55*b* of the photo-interrupter 55, the filler 54 blocks light from the light-emitting unit 55*a*, so that a detection signal of the light receiving unit 55*b* is reduced. In contrast, if the filler 54 is removed from between the light-emitting unit 55*a* and the light receiving unit 55*b*, light from the light-emitting unit 55*a* is incident on the light receiving unit 55*b*, so that a detection signal of the light receiving unit 55*b* is increased. In this mechanism, the arrival of the heating area changing member 27 at a predetermined position is detected based on the magnitude of the detection signal of the light receiving unit 55*b*.

There is an advantage that, by causing the filler 54 to operate simultaneously with the heating area changing member 27 via the link member 58 as in the embodiment, it becomes possible to cope with the case where it is difficult to dispose the filler 54 and the photo-interrupter 55 in the vicinity of the heating area changing member 27. It may be possible to directly detect the position of the heating area changing member 27 without via the filler 54. The position detection sensor is not limited to the transmissive photo-interrupter, and may be a reflective photo-interrupter that detects the position of the heating area changing member 27 based on presence or absence of reflected light from the heating area changing member 27 or the filler 54.

Figure 12:
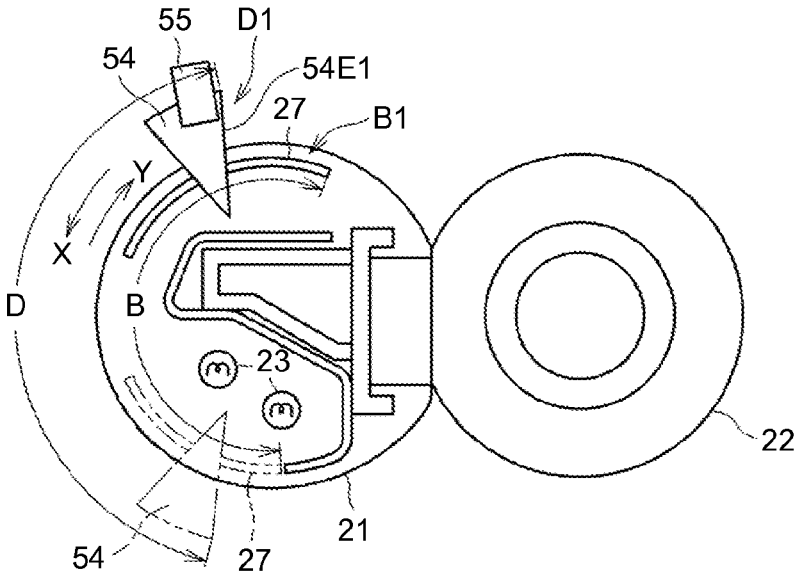
FIG. 12 is a schematic diagram of the fixing device including the position detecting mechanism.

In FIG. 12, a range indicated by a reference sign B is a moving range in which the heating area changing member 27 moves, and a range indicated by a reference sign D is a moving range in which the filler 54 moves. At the end of printing or at the activation of the power of the printer, the heating area changing member 27 is disposed at a reference position B1 that is set in advance at one end of the moving range B. The reference position B1 is the above-described retracted position at which the heating area changing member 27 is disposed when the fixing belt 21 need not be shielded from heat, and a position at which the heating area (direct heating area) of the fixing belt 21 is maximized.

When the heating area changing member 27 is disposed at the above-described reference position B1, the filler is disposed at a reference corresponding position D1, which is at one end of the moving range D and corresponds to the reference position B1 of the heating area changing member 27. In this state, if the heating area changing member 27 is moved from the reference position B1 to an arbitrary shielding position in order to reduce the heating area of the fixing belt 21, the filler 54 moves along with this movement. In contrast, if the heating area changing member 27 is moved back from a destination shielding position to the reference position B1, the filler 54 moves back to the reference corresponding position D1 along with this movement.

In this way, the filler 54 can move back and forth in a forward direction X of when moving with the movement of the heating area changing member 27 from the reference position B1 to an arbitrary shielding position, and in a backward direction Y that is opposite to the forward direction X and of when moving with the movement of the heating area changing member 27 from an arbitrary shielding position to the reference position B1.

Figure 13:
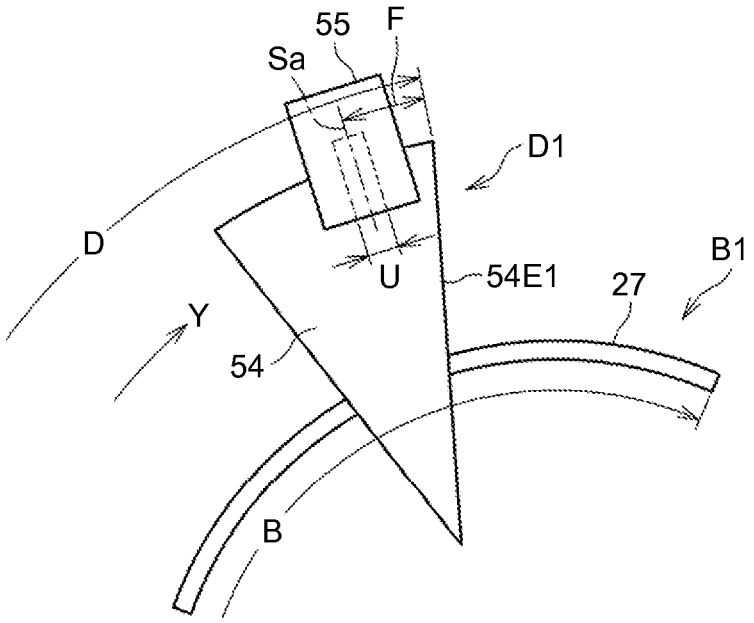
FIG. 13 is a diagram for explaining the disposition of the position detection sensor.

The photo-interrupter 55 is provided at the reference corresponding position D1 of the filler 54. As illustrated in FIG. 13, the photo-interrupter 55 is disposed such that a detection position Sa is located upstream of and separated by a distance F from a downstream edge 54E1 of the filler 54 in the backward direction Y when the filler 54 is disposed at the reference corresponding position D1. If the detection position Sa of the photo-interrupter 55 covers a certain range U, the disposition is set such that the entire range U is located upstream of the downstream edge 54E1 of the filler 54 in the backward direction Y.

A method of controlling the position of the heating area changing member 27 of the embodiment will be described below.

A position control method when the heating area changing member 27 is moved from the reference position B1 illustrated in FIG. 14A to a shielding position B2 illustrated in FIG. 14C will be described.

Figure 14A:
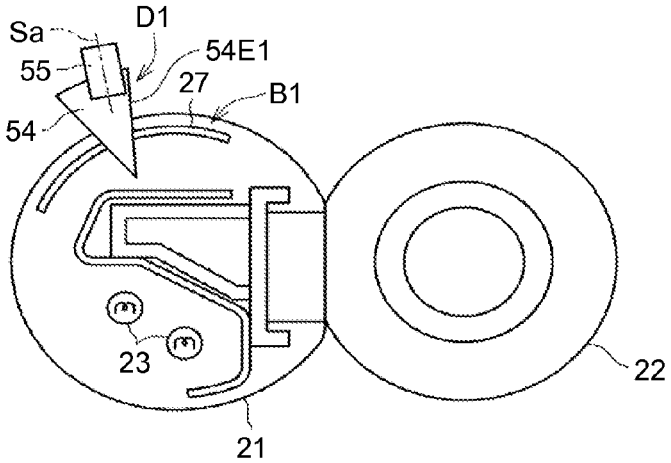
FIGS. 14A to 14C are diagrams illustrating operation of moving the heating area changing member to the shielding position.
Figure 14B:
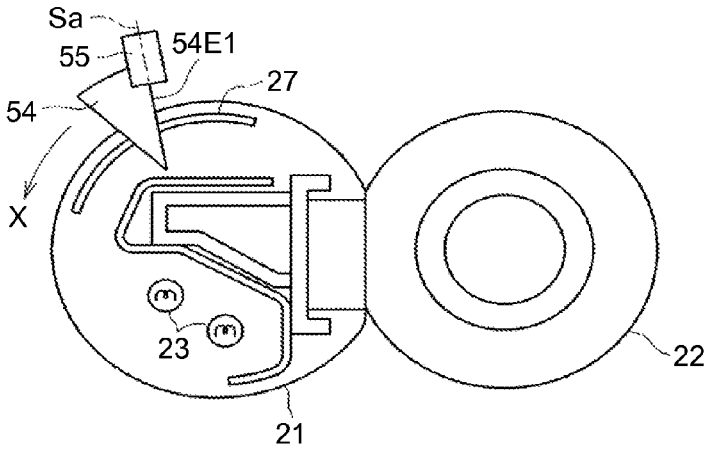

If the filler 54 moves in the forward direction X along with the movement of the heating area changing member 27 to the shielding position B2, as illustrated in FIG. 14B, the upstream edge 54E1 of the filler 54 in the forward direction X reaches the detection position Sa of the photo-interrupter 55. With the movement of the upstream edge 54E1 of the filler 54 through the detection position Sa, light is transmitted from the light-emitting unit to the light receiving unit, a detection signal of the light receiving unit is increased, and therefore, the position of the filler 54 is detected. Therefore, the position of the heating area changing member 27 at the start of the movement is detected. A control unit (not illustrated) adjusts the pulse volume of the stepping motor on the basis of information on the position of the heating area changing member 27 detected in this way, and causes the heating area changing member 27 to move to and stop at the shielding position B2 illustrated in FIG. 14C.

Figure 15A:
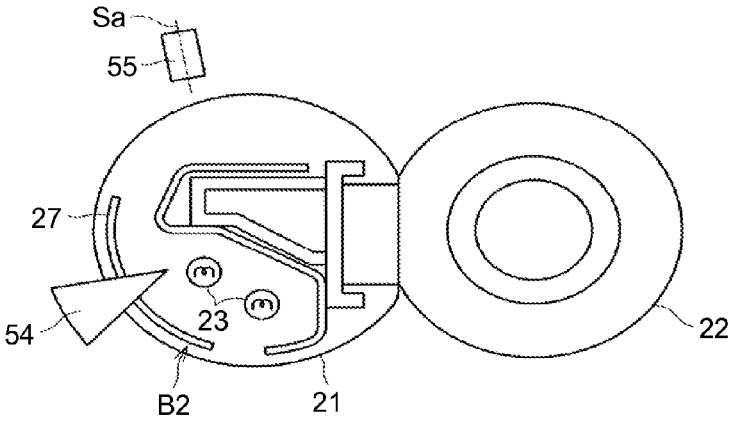
FIGS. 15A to 15C are diagrams illustrating operation of moving the heating area changing member to a reference position.
Figure 15B:
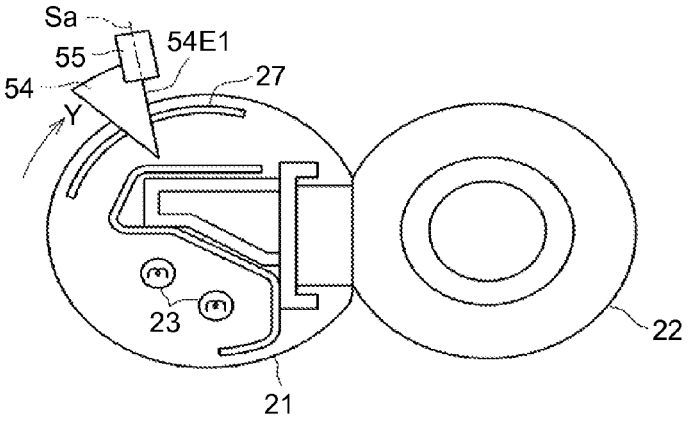
Figure 15C:
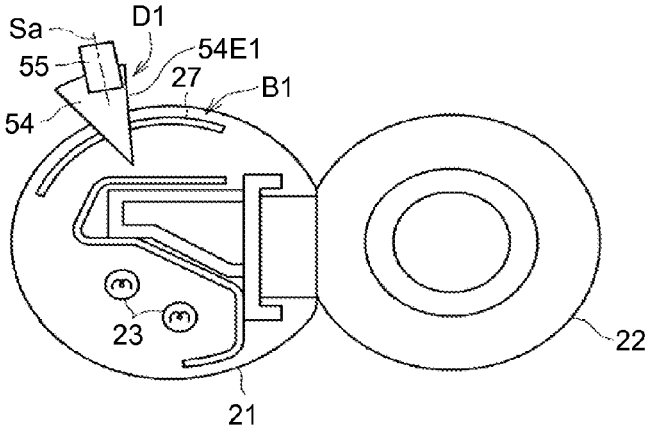

With reference to FIGS. 15A to 15C, a position control method when the heating area changing member 27 is moved back from the shielding position B2 to the reference position B1 will be described.

In this case, if the heating area changing member 27 is moved toward the reference position B1, as illustrated in FIG. 15B, the photo-interrupter 55 detects the position of the filler 54 before the heating area changing member 27 reaches the reference position B1. Specifically, if the filler 54 moves in the backward direction Y along with the movement of the heating area changing member 27, the downstream edge 54E1 of the filler 54 in the backward direction Y reaches the detection position Sa of the photo-interrupter 55. Therefore, light from the light-emitting unit to the light receiving unit is blocked, a detection signal of the light receiving unit is reduced, and therefore, the position of the filler 54 is detected. Consequently, the position of the heating area changing member 27 just before the reference position is detected. The control unit (not illustrated) adjusts the pulse volume of the stepping motor on the basis of information on the position of the heating area changing member 27 detected in this way, and causes the heating area changing member 27 to move to and stop at the reference position B1 illustrated in FIG. 15C.

Figure 14C:
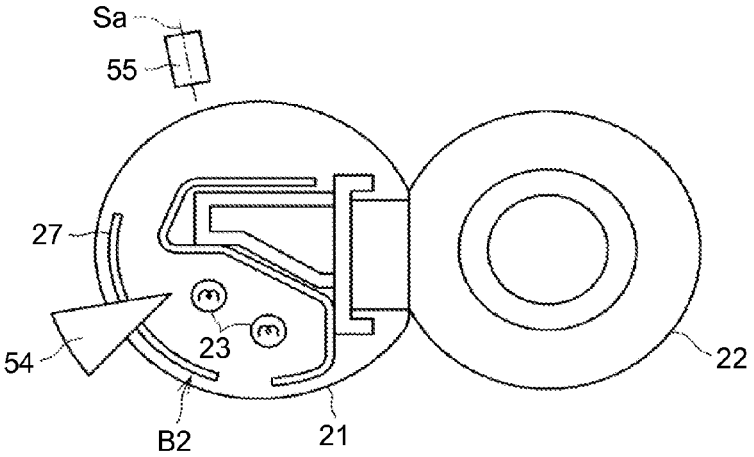

While the method of controlling the position of the heating area changing member 27 is described above, the control method is also applicable to movement to an arbitrary shielding position other than the shielding position B2 illustrated in FIGS. 14A to 14C and movement from an arbitrary shielding position other than the shielding position B2 illustrated in FIGS. 15A to 15C.

As described above, according to an embodiment of the present invention, while the heating area changing member 27 is moving from the reference position to an arbitrary shielding position and moving back from an arbitrary shielding position to the reference position, the position of the heating area changing member 27 is detected and the stop position of the heating area changing member 27 is controlled based on the detection. Therefore, the positional accuracy of the heating area changing member 27 at the reference position and the shielding position can be improved. Further, the position detection during either movement is performed by a single photo-interrupter (a detecting unit including a light-emitting unit and a light receiving unit as a pair), so that it is possible to further reduce the size and cost of the apparatus.

In the embodiment, the detection position Sa of the photo-interrupter is located upstream of the downstream edge of the filler in the backward direction Y when the filler is disposed at the reference corresponding position D1 (see FIG. 13). Therefore, in the embodiment, when the heating area changing member 27 is moved back to the reference position B1, the downstream edge 54E1 of the filler in the backward direction Y stops at a position downstream of and separated by the distance F from the detection position Sa.

Incidentally, unlike the embodiments, if the downstream edge 54E1 of the filler 54 in the backward direction Y is stopped at the detection position Sa when the heating area changing member 27 moves back to the reference position B1, it may become difficult to detect the edge 54E1 of the filler 54 when the filler 54 subsequently moves in the forward direction X. In contrast, in the embodiment, the downstream edge 54E1 of the filler 54 in the backward direction Y is stopped at a position downstream of and separated by the distance F from the detection position Sa. Therefore, it is possible to infallibly detect the edge 54E1 of the filler 54 when the heating area changing member 27 subsequently moves to an arbitrary shielding position.

It is preferable to reduce the distance F from the detection position Sa to the stop position of the downstream edge of the filler 54 because a time to stop the heating area changing member 27 can be reduced. Therefore, it is preferable to set the stop position of the edge of the filler 54 downstream of and in the vicinity of the detection position Sa.

While a case has been described in which the heating area changing member 27 moves from the reference position to the shielding position in the embodiments, it may be possible to first move the heating area changing member 27 to the shielding position and further moves it to a different shielding position.

Figure 16A:
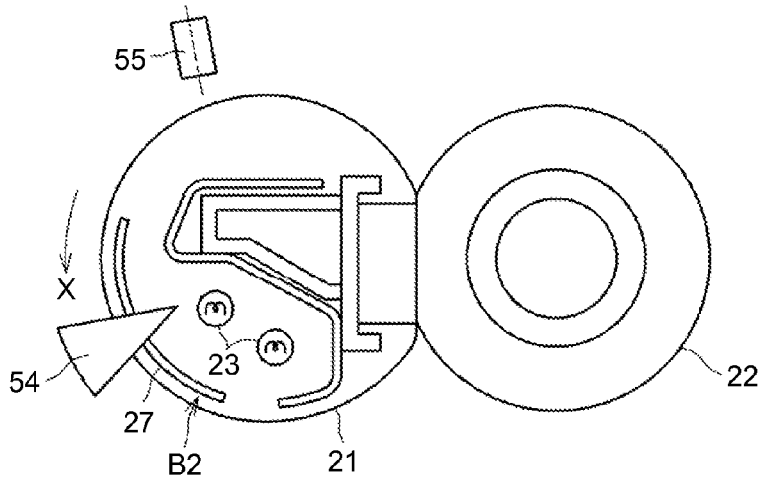
FIGS. 16A and 16B are diagrams illustrating operation of moving the heating area changing member from the shielding position to a different shielding position.
Figure 16B:
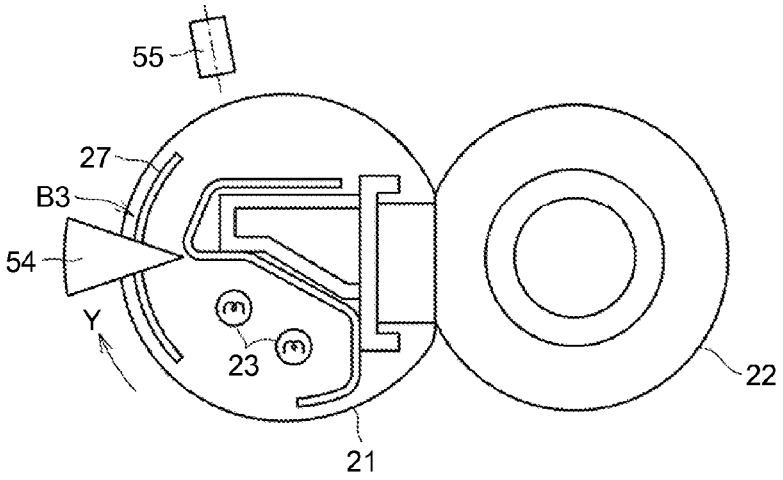
Figure 17:
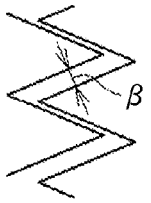
FIG. 17 is a diagram illustrating the play between tooth surfaces of gears.

However, as illustrated in FIGS. 16A and 16B, if the heating area changing member 27 moves in the backward direction Y from the first shielding position B2 to a different shielding position B3, the following issue may occur. In general, as illustrated in FIG. 17, a play (backlash) β in the circumferential direction is provided between tooth surfaces of gears engaging with each other. The same applies to the transmission gears 43, 44, and 45 for transmitting a driving force to the heating area changing member 27. Therefore, if a moving direction of the heating area changing member 27 just before it stops is changed, the rotation direction of the gears just before the stop is changed, so that the stop position may vary due to the play β between tooth surfaces of the gears. Therefore, as illustrated in FIGS. 16A and 16B, if the heating area changing member 27 moves in the backward direction Y to the different shielding position B3, the stop position is more likely to vary as compared to the case where the heating area changing member 27 moves in the forward direction X directly from the reference position B1 to the same shielding position B3. The variation in the stop position is not large. However, particularly in the configuration using a thin fixing belt with good temperature rise property as in the embodiments, the fixability may be reduced or the fixing belt may be deformed due to this variation.

To solve the variation in the stop position as described above, a method to always set the moving direction just before stop to the same direction may be employed. For example, by temporarily moving the heating area changing member 27 back from the first shielding position B2 to the reference position B1 and thereafter moving it to the different shielding position B3, the moving direction before stop can be the same direction as in the case of the movement directly from the reference position B1.

However, in the method of temporarily moving the heating area changing member 27 back to the reference position B1 and thereafter moving it to the next shielding position B3, there is a disadvantage that a moving time of the heating area changing member 27 increases. If the moving time of the heating area changing member 27 increases, temperature irregularity may occur on the surface of the fixing belt during the movement, so that the fixability may be reduced or the fixing belt may be deformed.

As described above, to move the heating area changing member 27 to the different shielding position B3, each of the method of temporarily moving the heating area changing member 27 back to the reference position B1 and the method of directly moving the heating area changing member 27 without moving it back has both the advantages and disadvantages. Therefore, it is preferable to select which of the methods is better by comparing the degrees of influence of the advantages and the degrees of influence of the disadvantages of the two methods. In the embodiment, the influence of the play between the tooth surfaces of the gears is negligible; therefore, the heating area changing member 27 is moved to the next shielding position B3 without being moved back to the reference position B1, in order to reduce the moving time and prevent occurrence of temperature irregularity.

Figure 18:
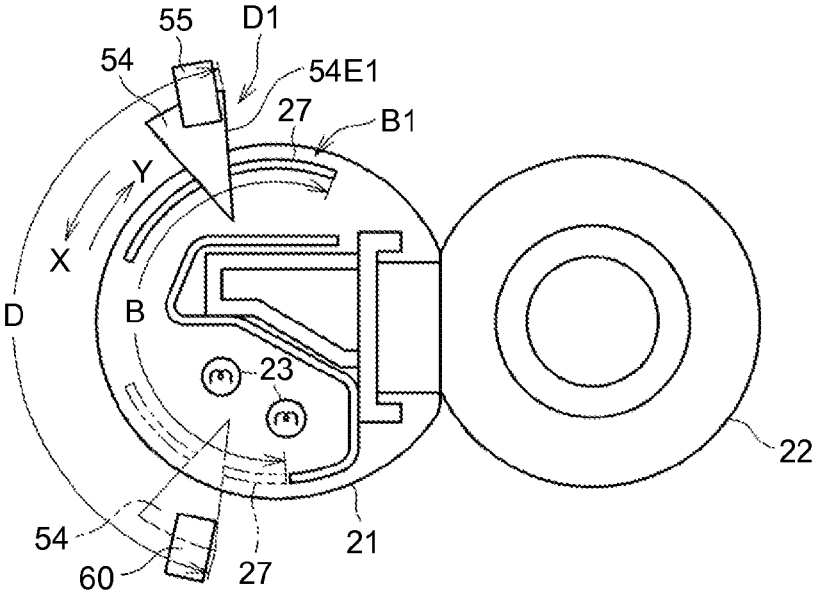
FIG. 18 is a diagram illustrating a configuration of a position detecting mechanism according to another embodiment.

FIG. 18 is a diagram illustrating a configuration of a position detecting mechanism of another embodiment.

In the embodiment illustrated in FIG. 18, two photo-interrupters, that is, the photo-interrupter 55 and a photo-interrupter 60, are provided as position detection sensors for detecting the position of the heating area changing member 27. Of the two photo-interrupters 55 and 60, the photo-interrupter 55 disposed at the reference corresponding position D1 of the filler 54 is provided for the same purpose as that of the photo-interrupter 55 of the above described embodiment. Specifically, the photo-interrupter 55 detects the position of the heating area changing member 27 via the filler 54 both when the heating area changing member 27 is moving from the reference position B1 to an arbitrary shielding position and when the heating area changing member 27 is moving back from an arbitrary shielding position to the reference position B1.

In contrast, the photo-interrupter 60 is disposed at an end opposite to the reference corresponding position D1 in the moving range D, and has a function different from that of the photo-interrupter 55. In the following, the second photo-interrupter 60 will be mainly described in detail. The photo-interrupter 55 disposed at the reference corresponding position D1 may be referred to as a first photo-interrupter, and the photo-interrupter 60 disposed at the opposite end may be referred to as a second photo-interrupter.

Similarly to the first photo-interrupter 55, the second photo-interrupter 60 is a transmissive photo-interrupter including a light-emitting unit and a light receiving unit, and detects the position of the heating area changing member 27 from the transmission or blocking of light from the light-emitting unit to the light receiving unit along with the movement of the filler 54. A reflective photo-interrupter may be used as the second photo-interrupter 60.

Figure 19:
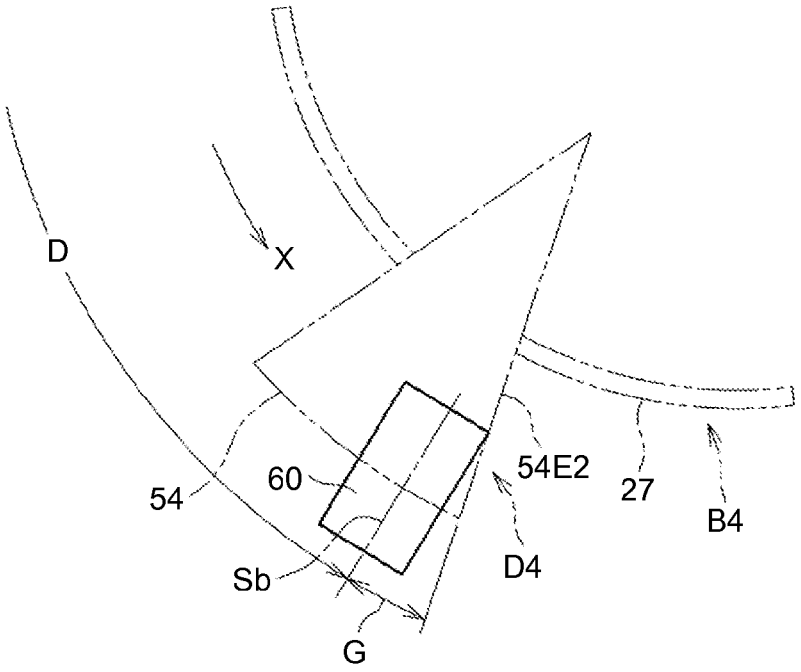
FIG. 19 is a diagram for explaining the disposition of a position detection sensor.

In FIG. 19, a position indicated by a reference sign B4 is a movement limit position when the heating area changing member 27 moves toward an end opposite to the reference position B1. The movement limit position is a position at which the heating area changing member 27 or a member that moves with the heating area changing member 27 comes in contact with a certain component and its further movement is restricted. A position D4 indicated in the figure is a limit corresponding position at which the filler 54 is disposed when the heating area changing member 27 is disposed at the movement limit position B4. As illustrated in FIG. 19, a detection position Sb of the second photo-interrupter 60 is located upstream of and separated by a distance G from a downstream edge 54E2 of the filler 54 in the forward direction X when the filler 54 is disposed at the limit corresponding position D4.

The function of the second photo-interrupter 60 will be described below.

Figure 20A:
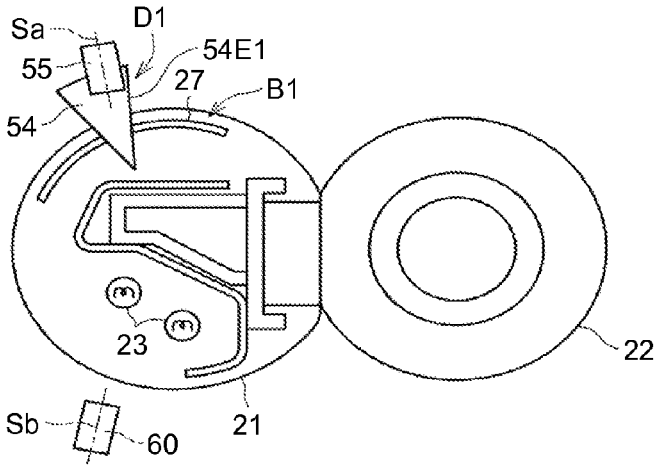
FIGS. 20A to 20C are diagrams illustrating operation of moving the heating area changing member to an end opposite to the reference position.
Figure 20B:
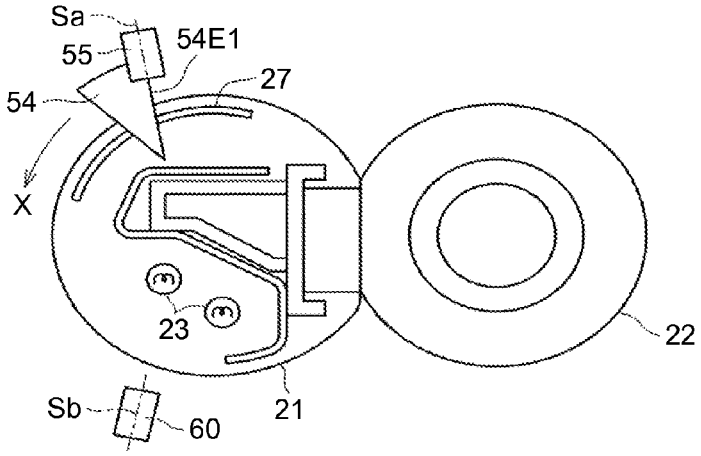
Figure 20C:
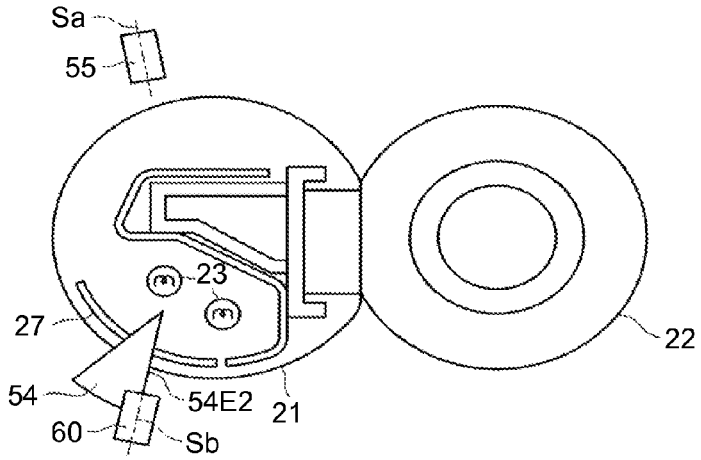

When the heating area changing member 27 moves from the reference position B1 illustrated in FIG. 20A toward an opposite end (shielding position) illustrated in FIG. 20C, the first photo-interrupter 55 detects the position of the heating area changing member 27 at the start of the movement as illustrated in FIG. 20B. The position detection by the first photo-interrupter 55 is the same as in the above-described embodiments.

A control unit (not illustrated) adjusts the pulse volume of the stepping motor on the basis of information on the position of the heating area changing member 27 detected by the first photo-interrupter 55, and causes the heating area changing member 27 to move toward the opposite end. In this case, however, if the stop position of the heating area changing member 27 is deviated from a target position due to pulse deviation or the like, the heating area changing member 27 may reach the movement limit position D4 and interfere with other components.

Therefore, in the embodiment, the second photo-interrupter 60 different from the first photo-interrupter 55 is used to prevent the heating area changing member 27 from reaching the movement limit position D4. Specifically, as illustrated in FIG. 20C, movement of the heating area changing member 27 is stopped when the downstream edge 54E2 of the filler 54 in the forward direction X reaches the detection position Sb of the second photo-interrupter 60 and when the second photo-interrupter 60 detects the edge 54E2. In the embodiment, the detection position Sb of the second photo-interrupter 60 is located upstream of the downstream edge 54E2 of the filler 54 in the forward direction X when the filler 54 is disposed at the limit corresponding position D4. Therefore, it is possible to detect the position just before the heating area changing member 27 reaches the movement limit position B4.

Consequently, it becomes possible to more reliably prevent the heating area changing member 27 from reaching the movement limit position B4 due to an unpredictable cause and from interfering with other components, making it possible to prevent breakage of components. By providing the second photo-interrupter 60 as described above, it is possible to prevent interference with other components without increasing the accuracy of position control by the stepping motor or the like. Therefore, options of the position control means can be increased.

In the embodiment, the position control in the case of moving the heating area changing member 27 back to the reference position B1 is the same as in the above-described embodiments, and therefore, explanation thereof will not be repeated. In the embodiment, it may be possible to stop movement of the heating area changing member 27 on the basis of position detection by the second photo-interrupter 60, and subsequently move the heating area changing member 27 to a different shielding position. In this case, if the influence of the play between tooth surfaces of the gears is negligible, it may be possible to move the heating area changing member 27 directly to a next shielding position without moving it back to the reference position B1, similarly to the above-described embodiment.

In the embodiments, examples have been described in which the present invention is applied to the fixing device including the heating area changing member that blocks heat from the halogen heater; however, the fixing device to which the present invention is applicable is not limited to these examples. For example, the present invention may be applied to an electromagnetic induction heating fixing device including a heating area changing member that block a magnetic flux generated from a magnetic flux generating means to change the heating area of the fixing member. The fixing member may be a hollow (tubular) or solid fixing roller, instead of the fixing belt. The image forming apparatus in which the fixing device of the present invention is installed is not limited to the printer illustrated in FIG. 1, and may be other printers, copiers, facsimile machines, or multifunction peripherals with functions of a printer, a copier, and a facsimile machine.

According an embodiment, a single position detection sensor can perform position detection both when the heating area changing member is moving from a reference position to an arbitrary position and when the heating area changing member is moving back from an arbitrary position to the reference position and thus it is possible to further reduce the size and cost of an apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member;

an opposing member that provides a fixing nip with the fixing member;

a heating unit that heats the fixing member;

a heating area changing member that moves to change a heating area of the fixing member heated by the heating unit;

a detected member that is displaced in accordance with a position of the heating area changing member; and a position detection sensor that detects a position of the heating area changing member, wherein the fixing device controls a stop position of the heating area changing member based on detection by the position detection sensor, and the single position detection sensor detects the position of the heating area changing member both when the heating area changing member is moving from a preset reference position to an arbitrary position and when the heating area changing member is moving back from an arbitrary position to the reference position, and when the heating area changing member moves back from an arbitrary position to the reference position, the fixing device controls a stop position of the heating area changing member in the reference position based on detection of an edge of the detected member by the position detection sensor.

2. The fixing device according to claim 1, further comprising:

a detected member that is displaced in accordance with a position of the heating area changing member, wherein when the heating area changing member moves from the reference position to an arbitrary position, the fixing device controls a stop position of the heating area changing member in the arbitrary position based on detection of an edge of the detected member by the position detection sensor.

3. The fixing device according to claim 2, wherein the detected member moves back and forth in a forward direction and a backward direction, the forward direction being a direction in which the detected member moves accordingly when the heating area changing member moves from the reference position preset at one end of a moving range of the heating area changing member, to an arbitrary position, and the backward direction being a direction that is opposite to the forward direction and in which the detected member moves accordingly when the heating area changing member moves from an arbitrary position to the reference position, and a detection position of the position detection sensor is located upstream of a downstream edge of the detected member in the backward direction when the heating area changing member is disposed at the reference position.

4. The fixing device according to claim 2, wherein when the position detection sensor serves as a first position detection sensor, the fixing device further comprises a second position detection sensor different from the first position detection sensor, a detection position of the second position detection sensor is located upstream of a downstream edge of the detected member in the forward direction when the heating area changing member is disposed at a movement limit position located opposite to the reference position, and movement of the heating area changing member is stopped when the second position detection sensor detects the downstream edge of the detected member in the forward direction.

5. The fixing device according to claim 4, wherein the heating area changing member is, after stopping at a position detected by the second position detection sensor, movable to a next destination without temporarily moving back to the reference position.

6. The fixing device according to claim 1, wherein the detected member moves back and forth in a forward direction and a backward direction, the forward direction being a direction in which the detected member moves accordingly when the heating area changing member moves from the reference position preset at one end of a moving range of the heating area changing member, to an arbitrary position, and the backward direction being a direction that is opposite to the forward direction and in which the detected member moves accordingly when the heating area changing member moves from an arbitrary position to the reference position, and a detection position of the position detection sensor is located upstream of a downstream edge of the detected member in the backward direction when the heating area changing member is disposed at the reference position.

7. The fixing device according to claim 1, wherein the heating area changing member is, after moving from the reference position to an arbitrary position, movable to a next destination without temporarily moving back to the reference position.

8. The fixing device according to claim 1, wherein when the position detection sensor serves as a first position detection sensor, the fixing device further comprises a second position detection sensor different from the first position detection sensor, a detection position of the second position detection sensor is located upstream of a downstream edge of the detected member in the forward direction when the heating area changing member is disposed at a movement limit position located opposite to the reference position, and movement of the heating area changing member is stopped when the second position detection sensor detects the downstream edge of the detected member in the forward direction.

9. The fixing device according to claim 8, wherein the heating area changing member is, after stopping at a position detected by the second position detection sensor, movable to a next destination without temporarily moving back to the reference position.

10. The fixing device according to claim 1, wherein the heating area of the fixing member increases as the heating area changing member moves toward the reference position, and the heating area of the fixing member decreases as the heating area changing member moves opposite to the reference position.

11. An image forming apparatus comprising the fixing device according to claim 1.

* * * * *